US005192044A

United States Patent [19]

Baskin

[11] Patent Number: 5,192,044

[45] Date of Patent: Mar. 9, 1993

[54] EXTRA ROLL CADDY FOR TOILET PAPER AND THE LIKE

[76] Inventor: Arnold B. Baskin, 6836 108th St., Apt. A-46, Forest Hills, N.Y. 11375-3366

[21] Appl. No.: 808,166

[22] Filed: Dec. 13, 1991

[51] Int. Cl.[5] ..... A47F 5/00

[52] U.S. Cl. ..... 248/309.1; 242/55.3

[58] Field of Search ..... 248/309.1; 206/391; 242/55.2, 55.3, 55.53, 55.42; 312/39, 40, 41

[56] References Cited

U.S. PATENT DOCUMENTS

| | | | |
|---|---|---|---|
| 2,790,608 | 4/1957 | Sieven | 242/55.3 |
| 4,205,802 | 6/1980 | Economakis | 242/55.3 |
| 4,756,485 | 7/1988 | Bastian | 312/39 X |
| 4,775,109 | 10/1988 | Tegg | 206/391 |
| 4,807,823 | 2/1989 | Wyant | 242/55.3 |
| 4,856,724 | 8/1989 | Jespersen | 312/39 X |
| 5,012,986 | 5/1991 | Needle | 242/55.53 X |

FOREIGN PATENT DOCUMENTS

| | | | |
|---|---|---|---|
| 877133 | 8/1971 | Canada | 242/55.3 |

*Primary Examiner*—J. Franklin Foss
*Attorney, Agent, or Firm*—Richard L. Miller

[57] ABSTRACT

An extra roll caddy is provided for toilet paper and the like, which consists of an adjustable auxiliary holder for dispensing an auxiliary roll of toilet paper therefrom. A mechanism is for adjustable mounting the adjustable auxiliary holder to a roller in an existing fixed toilet paper holder on a flat vertical wall. In one instance the adjustable auxiliary holder can be positioned above the existing fixed toilet paper holder and in another instance the adjustable auxiliary holder can be positioned below the existing fixed toilet paper holder.

4 Claims, 2 Drawing Sheets

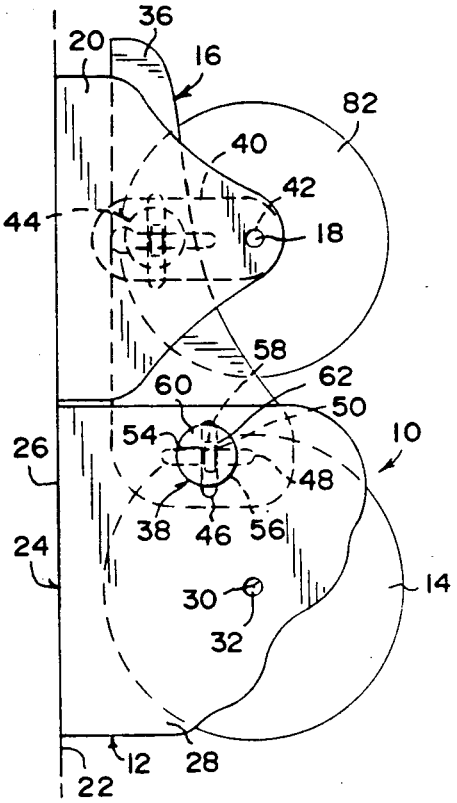
Fig. 4a
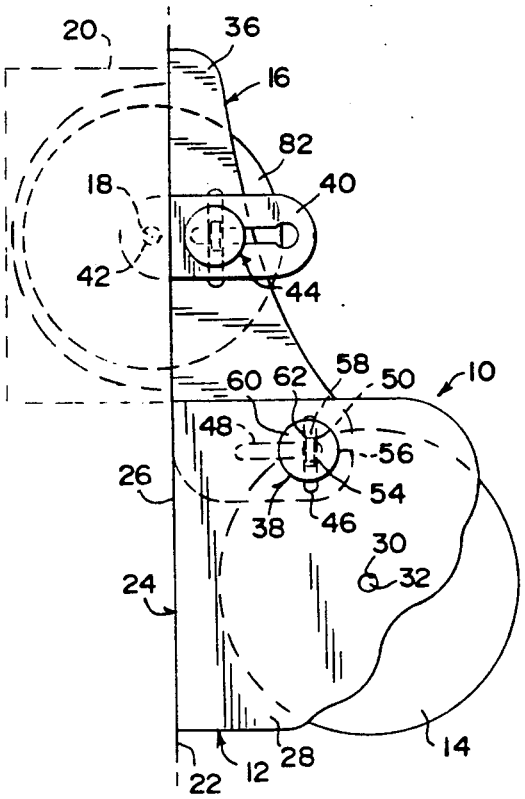
Fig. 5a
Fig. 7
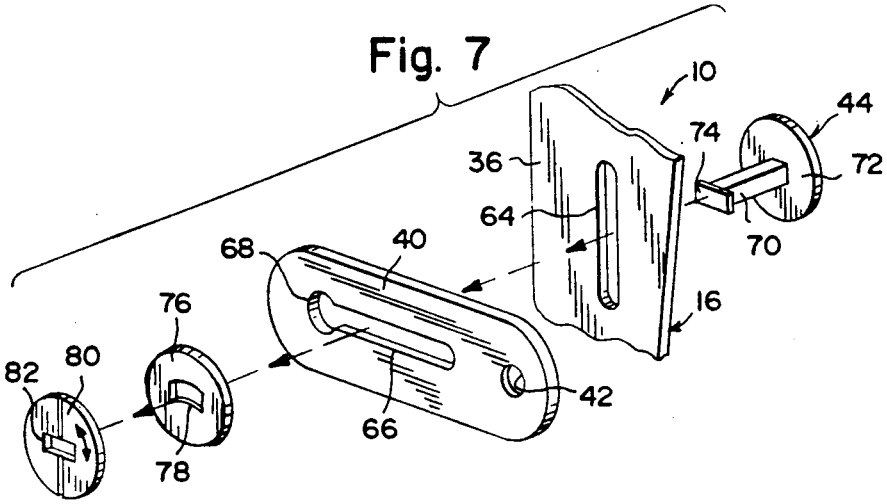

EXTRA ROLL CADDY FOR TOILET PAPER AND THE LIKE

BACKGROUND OF THE INVENTION

The instant invention relates generally to toilet paper holders and more specifically it relates to an extra roll caddy for toilet paper and the like.

Numerous toilet paper holders have been provided in the prior art that are adapted to retain just one roll of toilet paper for each holder, so that the toilet paper from the just one roll can be dispensed therefrom. While these units may be suitable for the particular purpose to which they address, they would not be as suitable for the purposes of the present invention as heretofore described.

SUMMARY OF THE INVENTION

A primary object of the present invention is to provide an extra roll caddy for toilet paper and the like that will overcome the shortcomings of the prior art devices. Another object is to provide an extra roll caddy for toilet paper and the like that can be installed to an existing fixed toilet paper holder for the purpose of supplying a second or spare roll of toilet paper thereto.

An additional object is to provide an extra roll caddy for toilet paper and the like that is versatile, adjustable and adaptable to various types of existing fixed toilet paper holders, whether they are of the protruding or recessive types of holders.

A further object is to provide an extra roll caddy for toilet paper and the like that is simple and easy to use.

A still further object is to provide an extra roll caddy for toilet paper and the like that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

Figure 1:
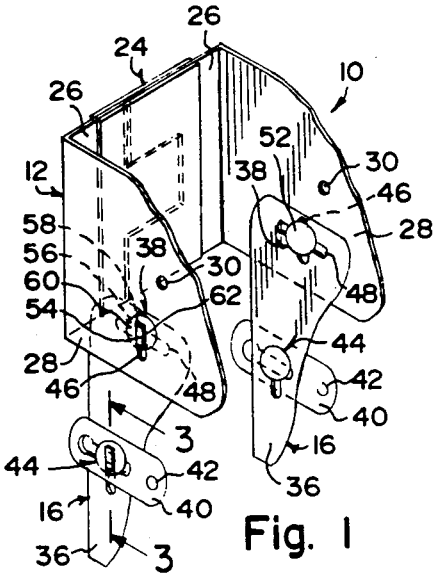
FIG. 1 is a diagrammatic perspective view of the instant invention per se.
Figure 2:
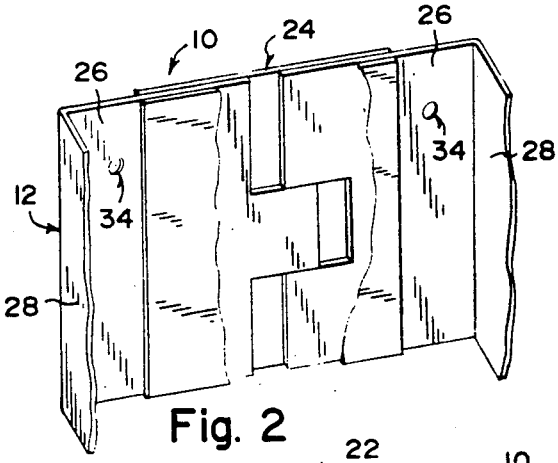
FIG. 2 is an enlarged partial perspective view illustrating the adjustable expanding mechanism in greater detail.
Figure 6:
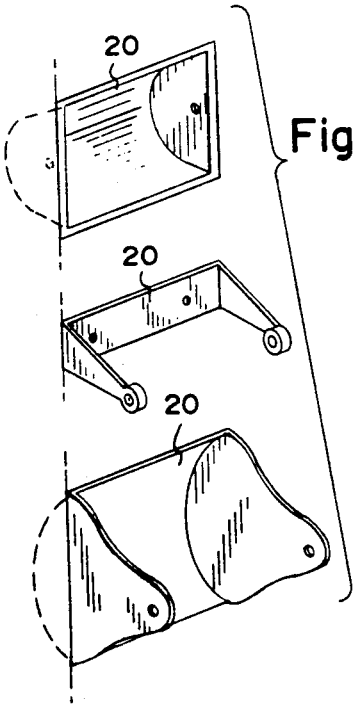
Figure 5:
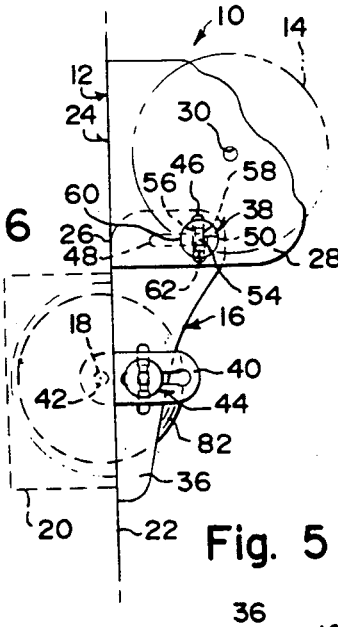
Figure 4:
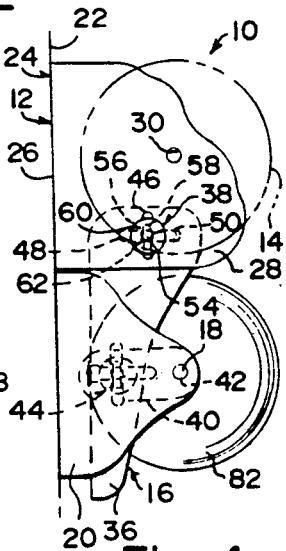
FIG. 4 is a diagrammatic side view of the instant invention installed above an existing externally mounted rolled paper holder.
Figure 3:
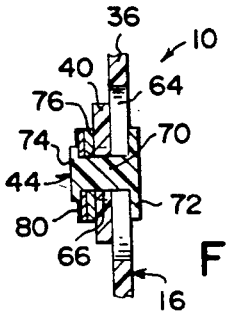
FIG. 3 is an enlarged partial cross sectional view taken along line 3—3 in FIG. 1.

FIG. 4*a* is an enlarged diagrammatic view similar to FIG. 4, but with the instant invention installed below an existing externally mounted rolled paper holder;

FIG. 5 is a diagrammatic side view of the instant invention installed above an existing flush mounted rolled paper holder;

FIG. 5*a* is an enlarged diagrammatic view similar to FIG. 5, but with the instant invention installed below an existing flush mounted rolled paper holder;

FIG. 6 is a diagrammatic view illustrating three typical existing rolled paper holders with which the instant invention can cooperate with; and FIG. 7 is a diagrammatic enlarged partial perspective view illustrating in greater detail the holding clip shown in FIG. 3.

DETAILED DESCRIPTION OF THE PREFERRED EMBODIMENTS

Turning now descriptively to the drawings, in which similar reference characters denote similar elements throughout the several views, the Figures illustrate an extra roll caddy 10 for toilet paper and the like which consists of an adjustable auxiliary holder 12 for dispensing an auxiliary roll of toilet paper 14 therefrom. A mechanism 16 is for adjustable mounting the adjustably auxiliary holder 12 to a roller 18 in an existing fixed toilet paper holder 20 on a flat vertical wall 22. In one instance the adjustable auxiliary holder 12 can be positioned above the existing fixed toilet paper holder 20 and in another instance the adjustable auxiliary holder 12 can be positioned below the existing fixed toilet paper holder 20.

The adjustable auxiliary holder 12 includes a telescopic back section 24 having two interconnecting slide friction segments 26, so as to adjust to various sized existing fixed toilet paper holders 20. A pair of side sections 28 are provided with each extending at a right angle from one of the slide friction segments 26. Each side section 28 has a hole 30 for supporting an auxiliary roller 32 for the auxiliary roll of toilet paper 14. A mechanism 34 for mounting said back section to the flat vertical wall, which can be mounting holes or adhesive tape.

The adjustable mounting mechanism 16 includes a pair of elongated support legs 36. A mechanism 38 is for adjusting each support leg 36 horizontally and vertically to one side section 38 of the adjustable auxiliary holder 12. A pair of arm members 40 are provided with each arm member 40 having a hole 42 at one end for engagement with the roller 18 in the existing fixed toilet paper holder 20. A mechanism 44 is for adjusting each arm member 40 horizontally and vertically to one support leg 36.

Each first adjusting mechanism 38 includes the respective side section 28 having a vertical slot 46. The respective support leg 36 has a horizontal slot 48 at one end thereof. A square pin friction fastener 50 has a large circular head 52 at one end and a small rectangular head 54 at an opposite end, which fits through the vertical slot 46 in the side section 28 and the horizontal slot 48, in the support leg 36, which permits translational motion without rotational movement between support leg 36 and arm member 40. A curved spring washer 56 has a rectangular aperture 58, which fits over the small rectangular head 54 of the square pin friction fastener 50. A flat lock washer 60 has a rectangular aperture 62, which fits over the small rectangular head 54 of the square pin friction fastener 50, so that when the lock washer 60 is rotated ninety degrees it will retain the square pin friction fastener 50 thereto.

Each second adjusting mechanism 44 includes the respective support leg 36 having a vertical slot 64 approximately midway thereof. The respective arm member 40 has a longitudinal slot 66 with an enlarged circular portion 68 at one end thereof opposite from the hole 42. A square pin fastener 70 has a large circular head 72 at one end and a small rectangular head 74 at an opposite end, which fits through the vertical slot 64 in the support leg 36 and the longitudinal slot 66 in the arm member 40. A curved spring washer 76 has a rectangular aperture 78 which fits over the small rectangular head 74 of the square pin friction fastener 70, so that when the lock washer 80 is rotated ninety degrees it will retain the square pin friction fastener 70 thereto.

This arrangement permits the arm member 40 to be rotated 180° when the square pin 70 is positioned in the enlarged circular portion 68 so, that the instant invention can be adapted for either protruding or flush fixed toilet paper holders with out dismantling the mechanism 44.

The existing fixed toilet paper holder 30 can be an externally mounted type, as shown in FIG. 4, 4*a* and 6. The existing fixed toilet paper holder 20 can also be a flush mounted type, as shown in FIGS. 5, 5*a* and 6. The extra roll caddy 10 will always supply the auxiliary roll of toilet paper 14 as a spare in conjunction with the regular roll of toilet paper 82, so that a user will normally never run out of toilet paper.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An extra roll caddy for toilet paper and the like which comprises:

a) an adjustable auxiliary holder for dispensing an auxiliary roll of toilet paper therefrom, wherein said adjustable auxiliary holder includes:

i) a telescopic back section having two interconnecting slide friction segments, so as to adjust to various sized existing fixed toilet paper holders;

ii) a pair of side sections, each extending at a right angle from one of said slide friction segments with each said side section having a hole for supporting an auxiliary roller for the auxiliary roll of toilet paper; and iii) means for mounting said back section to a flat vertical wall; and b) means for adjustable mounting said adjustable auxiliary holder to a roller in an existing fixed toilet paper holder on the flat vertical wall, so that in one instance said adjustable auxiliary holder can be positioned above the existing fixed toilet paper holder and in another instance said adjustable auxiliary holder can be positioned below the existing fixed toilet paper holder.

2. An extra roll caddy for toilet paper and the like as recited in claim 1, wherein said adjustable mounting means includes:

a) a pair of elongated support legs;

b) means for adjusting each said support leg horizontally and vertically to one said side section of said adjustable auxiliary holder;

c) a pair of arm members, with each said arm member having a hole at one end for engagement with the roller in the existing fixed toilet paper holder; and d) means for adjusting each said arm member horizontally and vertically to one said support leg.

3. An extra roll caddy for toilet paper and the like recited in claim 2, wherein each said first adjusting means includes:

a) said respective side section having a vertical slot;

b) said respective support leg having a horizontal slot at one end thereof;

c) a square pin friction fastener having a large circular head at one end and a small rectangular head at an opposite end with fits through said vertical slot in said side section and said horizontal slot in said support leg;

d) a curved spring washer having a rectangular aperture which fits over said small rectangular head of said square pin friction fastener; and e) a flat lock washer having a rectangular aperture which fits over said small rectangular head of said square pi friction fastener, so that when said lock washer is rotated ninety degrees it will retain said square pin friction fasten thereto.

4. An extra roll caddy for toilet paper and the like recited in claim 3, wherein each said second adjusting means includes:

a) said respective support leg having a vertical slot approximately midway thereof;

b) said respective arm member having a longitudinal slot with an enlarged circular portion at one end thereof opposite from said hole;

c) a square pin friction fastener having a large circular head at one end and a small rectangular head at an opposite end, which fits through said vertical slot in said support leg and said longitudinal slot in said arm member;

d) a curved spring washer having a rectangular aperture which fits over said small rectangular head of said square pin friction fastener; and e) a flat lock washer having a rectangular aperture which fits over said small rectangular head of said square pin friction fastener, so that when said lock washer is rotated ninety degrees it will retain said square pin friction fastener thereto.

* * * * *